US009939825B2

(12) United States Patent
Alexander

(10) Patent No.: US 9,939,825 B2
(45) Date of Patent: Apr. 10, 2018

(54) HVAC ACTUATOR WITH LINE VOLTAGE INPUT

(71) Applicant: Johnson Controls Technology Company, Holland, MI (US)

(72) Inventor: Robert K. Alexander, Jackson, WI (US)

(73) Assignee: Johnson Controls Technology Company, Auburn Hills, MI (US)

( * ) Notice: Subject to any disclaimer, the term of this patent is extended or adjusted under 35 U.S.C. 154(b) by 804 days.

(21) Appl. No.: 14/475,141

(22) Filed: Sep. 2, 2014

(65) Prior Publication Data

US 2016/0061480 A1 Mar. 3, 2016

(51) Int. Cl.

| | |
|---|---|
| ***F24F 11/00*** | (2006.01) |
| ***G05F 1/10*** | (2006.01) |
| ***F24F 13/14*** | (2006.01) |

(52) U.S. Cl.

CPC ..... *G05F 1/10* (2013.01); *F24F 11/0009* (2013.01); *F24F 11/0076* (2013.01); *F24F 13/1426* (2013.01)

(58) Field of Classification Search

CPC ..... G05F 1/10; F24F 11/0076; F24F 11/0009; F24F 13/1426

USPC ..... 307/109

See application file for complete search history.

(56) References Cited

U.S. PATENT DOCUMENTS

| | | | | |
|---|---|---|---|---|
| 3,982,425 | A * | 9/1976 | McLain | B06B 1/0215 367/137 |
| 4,184,373 | A * | 1/1980 | Evans | G01N 29/11 73/588 |
| 5,121,075 | A * | 6/1992 | Roach | H03G 3/001 330/126 |
| 5,394,035 | A * | 2/1995 | Elwell | H03K 5/22 327/14 |
| 6,011,345 | A * | 1/2000 | Murray | H01L 41/042 310/316.01 |
| 2011/0050036 | A1* | 3/2011 | Gilardi | H01L 41/042 310/317 |
| 2012/0290136 | A1* | 11/2012 | Romanowich | F24F 13/1426 700/276 |
| 2014/0142758 | A1* | 5/2014 | McNallan | G05B 15/02 700/275 |
| 2014/0158919 | A1* | 6/2014 | Burt | F16K 31/535 251/4 |
| 2017/0025940 | A1* | 1/2017 | Antonelli | H02K 35/06 |

* cited by examiner

*Primary Examiner* — Thienvu Tran
*Assistant Examiner* — Brian K Baxter
(74) *Attorney, Agent, or Firm* — Foley & Lardner LLP

(57) ABSTRACT

An actuator in a HVAC system includes a housing, a mechanical transducer, and an input connection configured to receive a voltage signal having a power supply line voltage. The actuator includes a voltage divider circuit having a capacitor disposed in series between the input connection and the mechanical transducer. The capacitor has a capacitance value based on an electrical impedance of the mechanical transducer. The voltage divider circuit is configured to receive the line voltage from the input connection, to use the capacitor to reduce the line voltage to a reduced voltage, and to provide the reduced voltage to the mechanical transducer.

19 Claims, 9 Drawing Sheets

| VIN | C5 | C6 |
|---|---|---|
| 120VAC | 3.3uF | 3.3uF |
| 230VAC | 1.5uF | 1.5uF |

HVAC ACTUATOR WITH LINE VOLTAGE INPUT

BACKGROUND

The present disclosure relates generally to the field of actuators in a building automation system. The present disclosure relates more particularly to an actuator capable of accepting a power supply line voltage input in a heating, ventilation, and air conditioning (HVAC) system for a building.

A building automation system (BAS) is, in general, a system of devices configured to control, monitor, and manage equipment in or around a building or building area. A BAS can include a HVAC system, a security system, a lighting system, a fire alerting system, another system that is capable of managing building functions or devices, or any combination thereof. BAS devices may be installed in any environment (e.g., an indoor area or an outdoor area) and the environment may include any number of buildings, spaces, zones, rooms, or areas. A BAS may include METASYS building controllers or other devices sold by Johnson Controls, Inc., as well as building devices and components from other sources.

A BAS may include one or more computer systems (e.g., servers, BAS controllers, etc.) that serve as enterprise level controllers, application or data servers, head nodes, master controllers, or field controllers for the BAS. Such computer systems may communicate with multiple downstream building systems or subsystems (e.g., an HVAC system, a security system, etc.) according to like or disparate protocols (e.g., LON, BACnet, etc.). The computer systems may also provide one or more human-machine interfaces or client interfaces (e.g., graphical user interfaces, reporting interfaces, text-based computer interfaces, client-facing web services, web servers that provide pages to web clients, etc.) for controlling, viewing, or otherwise interacting with the BAS, its subsystems, and devices. A BAS may include various types of controllable equipment (e.g., chillers, boilers, air handling units, dampers, motors, actuators, pumps, fans, etc.) that can be used to achieve a desired environment, state, or condition within a controlled space.

Some HVAC actuators require an input voltage of approximately 24 VAC for proper operation. However, a typical BAS in which the actuators are implemented provides electric power at a standard power supply line voltage (e.g., 120 VAC or 230 VAC at 50/60 Hz). Previous systems generally require the use of transformers or switching power supplies to provide the actuators with the required input voltage. It can be complicated and expensive to implement such devices in many HVAC systems. It would be desirable for an actuator in a HVAC system to accept a voltage input at a power supply line voltage.

SUMMARY

One implementation of the present disclosure is an actuator in a building HVAC system. The actuator includes a housing, a mechanical transducer, and an input connection configured to receive a voltage signal having a power supply line voltage. The actuator includes a voltage divider circuit having a capacitor disposed in series between the input connection and the mechanical transducer. The capacitor has a capacitance value based on an electrical impedance of the mechanical transducer. The voltage divider circuit is configured to receive the line voltage from the input connection, to use the capacitor to reduce the line voltage to a reduced voltage, and to provide the reduced voltage to the mechanical transducer.

In some embodiments, the voltage divider circuit is located within the housing of the actuator or within an adaptor configured to attach to the housing of the actuator. In some embodiments, the capacitance value is based on an electrical inductance of the mechanical transducer. In some embodiments, the capacitance value is based on a voltage value of the line voltage.

In some embodiments, wherein the input connection includes a first input connection configured to receive a voltage signal for driving the mechanical transducer in a first direction, and a second input connection configured to receive a voltage signal for driving the mechanical transducer in a second direction opposite the first direction. In some embodiments, the voltage divider circuit includes a first capacitor disposed in series between the first input connection and the mechanical transducer and a second capacitor disposed in series between the second input connection and the mechanical transducer.

In some embodiments, the actuator further includes a user-operable switch attached to the housing and configured to switch between multiple different values for the capacitance.

In some embodiments, the capacitor is a first capacitor and the voltage divider circuit further includes a second capacitor arranged in parallel with the first capacitor between the input connection and the mechanical transducer. The voltage divider circuit may include a switch operable to connect and disconnect at least one of the first capacitor and the second capacitor from the voltage divider circuit. Operating the switch may adjust a capacitance between the input connection and the mechanical transducer.

In some embodiments, voltage divider circuit is configured to measure the line voltage and to adjust an impedance between the input connection and the mechanical transducer based on the measured line voltage. In some embodiments, adjusting the impedance between the input connection and the mechanical transducer includes at least one of connecting and disconnecting the capacitor from the voltage divider circuit.

In some embodiments, adjusting the impedance between the input connection and the mechanical transducer includes determining an impedance of the mechanical transducer, using the impedance of the mechanical transducer and the measured line voltage to calculate an impedance required to reduce the line voltage to the reduced voltage, and adjusting the impedance between the input connection and the mechanical transducer to achieve the reduced voltage.

In some embodiments, the reduced voltage provided to the mechanical transducer is a first reduced voltage. The actuator may further include a time out circuit. The voltage divider circuit may be configured to provide a second reduced voltage, different from the first reduced voltage, to the time out circuit.

Another implementation of the present disclosure is an adaptor for an actuator in a HVAC system. The adaptor includes an input connection configured to receive a voltage signal having a power supply line voltage, an output connection configured to provide a reduced voltage signal to an actuator having a mechanical transducer, and a voltage divider circuit including a capacitor disposed in series between the input connection and the actuator. The capacitor has a capacitance value based on an electrical impedance of the mechanical transducer. The voltage divider circuit is configured to receive the line voltage from the input connection, to use the capacitor to reduce the line voltage to a reduced voltage, and to provide the reduced voltage to actuator via the output connection.

Another implementation of the present disclosure is a method for operating an actuator in a HVAC system using a power line voltage. The method includes providing an actuator including a housing, a mechanical transducer, and an input connection configured to receive a voltage signal having a power supply line voltage. The method further includes arranging a voltage divider circuit comprising a capacitor in series between the input connection and the mechanical transducer. The capacitor has a capacitance value based on an electrical impedance of the mechanical transducer. The method further includes receiving the line voltage at the voltage divider circuit via the input connection, using the capacitor to reduce the line voltage to a reduced voltage, and providing the reduced voltage from the voltage divider circuit to the mechanical transducer.

In some embodiments, the method includes locating the voltage divider circuit either within the housing of the actuator or within an adaptor configured to attach to the housing of the actuator.

In some embodiments, the method includes using at least one of an electrical inductance of the mechanical transducer and a voltage value of the line voltage to calculate the capacitance value, and selecting the capacitor from a set of multiple different capacitors based on the calculated capacitance value.

In some embodiments, the method includes using a user-operable switch attached to the housing to switch between multiple different values for the capacitance.

In some embodiments, the voltage divider circuit includes multiple capacitors arranged in parallel between the input connection and the mechanical transducer. The method may further include operating a switch arranged in series with at least one of the multiple capacitors to electrically connect or disconnect at least one of the multiple capacitors from the voltage divider circuit. Operating the switch may adjust a capacitance between the input connection and the mechanical transducer.

In some embodiments, the method includes measuring the line voltage and adjusting an impedance between the input connection and the mechanical transducer based on the measured line voltage. Adjusting the impedance between the input connection and the mechanical transducer may include at least one of connecting and disconnecting the capacitor from the voltage divider circuit.

In some embodiments, the method includes measuring the line voltage, determining an impedance of the mechanical transducer, using the impedance of the mechanical transducer and the measured line voltage to calculate an impedance required to reduce the line voltage to the reduced voltage, and adjusting the impedance between the input connection and the mechanical transducer to achieve the reduced voltage Those skilled in the art will appreciate that the summary is illustrative only and is not intended to be in any way limiting. Other aspects, inventive features, and advantages of the devices and/or processes described herein, as defined solely by the claims, will become apparent in the detailed description set forth herein and taken in conjunction with the accompanying drawings.

DETAILED DESCRIPTION

Figure 1:
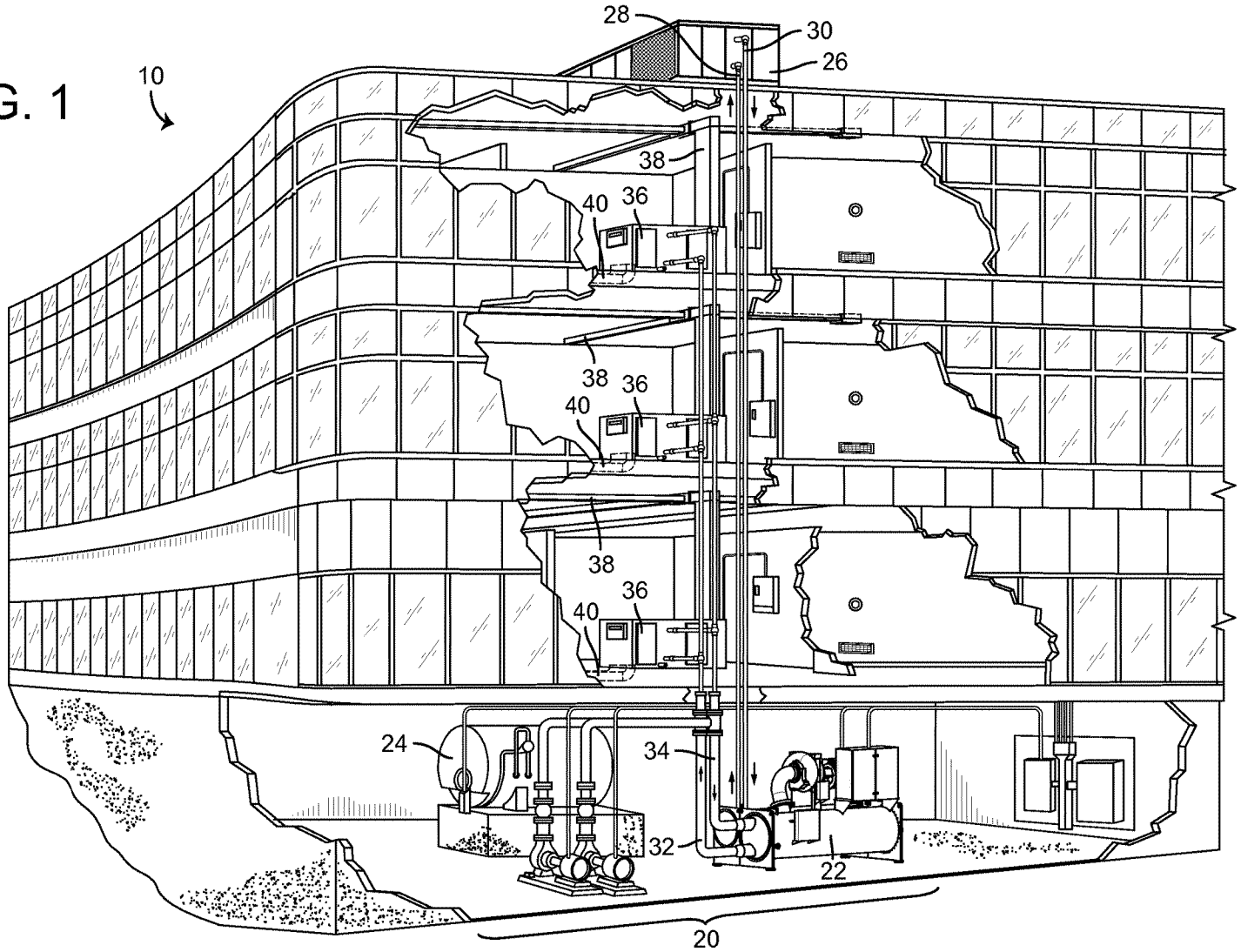
FIG. 1 is a perspective view of a building equipped with a heating, ventilation, and air conditioning (HVAC) system, according to an exemplary embodiment.

Referring generally to the FIGURES, actuators for use in a heating, ventilation, and air conditioning (HVAC) system are shown, according to various exemplary embodiments. Actuators may include any apparatus capable of providing forces and/or motion in response to a control signal. Actuators may use any of a variety of force transducers such as rotary motors, linear motors, hydraulic or pneumatic pistons/motors, piezoelectric elements, relays, comb drives, thermal bimorphs, or other similar devices to provide mechanical motion. An actuator may provide any combination of linear, curved, or rotary forces/motion. Some actuators use rotary motors to provide circular motion and/or linear motion (e.g., via a screw drive). Other actuators use linear motors to provide linear motion.

Actuators may include a variety of mechanical components such as gears, pulleys, cams, screws, levers, crankshafts, ratchets, or other components capable of changing or affecting the motion provided by the actuating/transducing element. In some embodiments, actuators do not produce significant motion in operation. For example, some actuators may be operated to exert a force or torque to an external element (e.g., a holding force) without affecting significant linear or rotary motion.

Advantageously, the actuator described herein may be capable of accepting a voltage input having a standard power line voltage (e.g., 120 VAC or 230 VAC at 50/60 Hz). According to an exemplary embodiment, the actuator includes an input connection configured to receive a voltage signal. The voltage signal may have a voltage typical of a power supply line in a building HVAC system (e.g., 120 VAC or 230 VAC at 50/60 Hz).

The actuator may include a voltage divider circuit configured to reduce the power supply line voltage to a reduced voltage (e.g., approximately 24 VAC) and to provide the reduced voltage to a mechanical transducer (e.g., an electric motor). In various embodiments, the voltage divider circuit is located within a housing of the actuator or within a separate adaptor configured to attach to the housing of the actuator. The voltage divider circuit may include a capacitor disposed in series between the input connection and the mechanical transducer. The capacitor may be configured to introduce an electrical impedance between the input connection and the mechanical transducer in order to reduce the line voltage to the reduced voltage.

In some embodiments, the capacitor has a capacitance value based on an electrical impedance of the mechanical transducer. The impedance of the mechanical transducer may be a function of the electrical inductance and/or the electrical resistance provided by the mechanical transducer. In some embodiments, the voltage divider circuit determines the impedance of the mechanical transducer and uses the impedance of the mechanical transducer to calculate an impedance required to reduce the line voltage to the reduced voltage. The voltage divider circuit may automatically adjust the impedance between the input connection and the mechanical transducer to achieve the reduced voltage.

In some embodiments, the actuator includes a user-operable switch. The switch may be attached to the housing or otherwise disposed with respect to the actuator. The switch may be configured to adjust the impedance provided by the voltage divider circuit to adapt the actuator to accommodate multiple different line voltages. For example, a first position of the user-operable switch may select a first impedance provided by the voltage divider circuit (e.g., for use with a 120 VAC line voltage), whereas a second position of the user-operable switch may select a second impedance provided by the voltage divider circuit (e.g., for use with a 230 VAC line voltage). Each switch position may correspond to a different reduction voltage factor provided by the voltage divider circuit in order to reduce different line voltages to the same or similar reduced voltage (e.g., 20-30 VAC, approximately 24 VAC, etc.).

In some embodiments, the voltage divider circuit includes multiple capacitors arranged in parallel between the input connection and the mechanical transducer. The actuator may further include a switch that is operable to connect and/or disconnect one or more of the capacitors from the voltage divider circuit. Operating the switch may adjust a capacitance between the input connection and the mechanical transducer, thereby affecting the impedance and corresponding voltage reduction provided by the voltage divider circuit. The switch may be operated by a user (e.g., manually) or by the voltage reduction circuit (e.g., automatically). In some embodiments, the voltage divider circuit is configured to measure the line voltage and to adjust an impedance between the input connection and the mechanical transducer (e.g., by operating the switch, by connecting or disconnecting capacitors or other circuit elements, etc.) based on the measured line voltage.

Referring now to FIG. 1, a perspective view of a building 10 is shown. Building 10 is serviced by a heating, ventilation, and air conditioning system (HVAC) system 20. HVAC system 20 is shown to include a chiller 22, a boiler 24, a rooftop cooling unit 26, and a plurality of air handling units (AHUs) 36. HVAC system 20 uses a fluid circulation system to provide heating and/or cooling for building 10. The circulated fluid may be cooled in chiller 22 or heated in boiler 24, depending on whether cooling or heating is required. Boiler 24 may add heat to the circulated fluid by burning a combustible material (e.g., natural gas). Chiller 22 may place the circulated fluid in a heat exchange relationship with another fluid (e.g., a refrigerant) in a heat exchanger (e.g., an evaporator). The refrigerant removes heat from the circulated fluid during an evaporation process, thereby cooling the circulated fluid.

The circulated fluid from chiller 22 or boiler 24 may be transported to AHUs 36 via piping 32. AHUs 36 may place the circulated fluid in a heat exchange relationship with an airflow passing through AHUs 36. For example, the airflow may be passed over piping in fan coil units or other air conditioning terminal units through which the circulated fluid flows. AHUs 36 may transfer heat between the airflow and the circulated fluid to provide heating or cooling for the airflow. The heated or cooled air may be delivered to building 10 via an air distribution system including air supply ducts 38 and may return to AHUs 36 via air return ducts 40. HVAC system 20 is shown to include a separate AHU 36 on each floor of building 10. In other embodiments, a single AHU (e.g., a rooftop AHU) may supply air for multiple floors or zones. The circulated fluid from AHUs 36 may return chiller 22 or boiler 24 via piping 34.

In some embodiments, the refrigerant in chiller 22 is vaporized upon absorbing heat from the circulated fluid. The vapor refrigerant may be provided to a compressor within chiller 22 where the temperature and pressure of the refrigerant are increased (e.g., using a rotating impeller, a screw compressor, a scroll compressor, a reciprocating compressor, a centrifugal compressor, etc.). The compressed refrigerant may be discharged into a condenser within chiller 22. In some embodiments, water (or another chilled fluid) flows through tubes in the condenser of chiller 22 to absorb heat from the refrigerant vapor, thereby causing the refrigerant to condense. The water flowing through tubes in the condenser may be pumped from chiller 22 to a rooftop cooling unit 26 via piping 28. Cooling unit 26 may use fan driven cooling or fan driven evaporation to remove heat from the water. The cooled water in rooftop unit 26 may be delivered back to chiller 22 via piping 30 and the cycle repeats.

Figure 2:
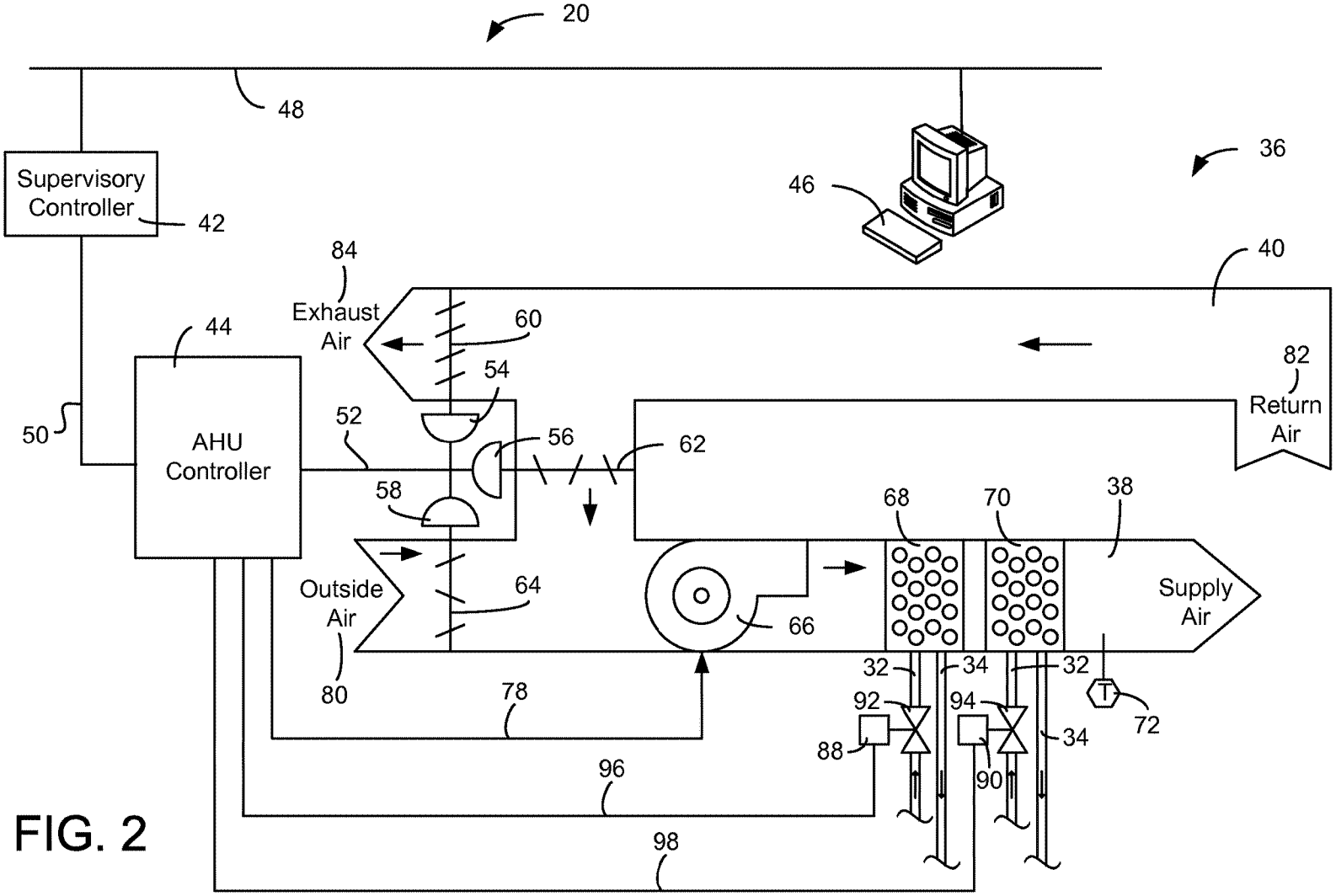
FIG. 2 is a block diagram illustrating the HVAC system of FIG. 1 in greater detail, according to an exemplary embodiment.

Referring now to FIG. 2, a block diagram of a portion of HVAC system 20 is shown, according to an exemplary embodiment. In FIG. 2, AHU 36 is shown as an economizer type air handling unit. Economizer type air handling units vary the amount of outside air and return air used by the air handling unit for heating or cooling. For example, AHU 36 may receive return air 82 from building 10 via return air duct 40 and may deliver supply air 86 to building 10 via supply air duct 38. AHU 36 may be configured to operate exhaust air damper 60, mixing damper 62, and outside air damper 64 to control an amount of outside air 80 and return air 82 that combine to form supply air 86. Any return air 82 that does not pass through mixing damper 62 may be exhausted from AHU 36 through exhaust damper 60 as exhaust air 84.

Each of dampers 60-64 may be operated by an actuator. As shown in FIG. 2, exhaust air damper 60 may be operated by actuator 54, mixing damper 62 may be operated by actuator 56, and outside air damper 64 may be operated by actuator 58. Actuators 54-58 may communicate with an AHU controller 44 via a communications link 52. AHU controller 44 may be an economizer controller configured to use one or more control algorithms (e.g., state-based algorithms, extremum seeking control algorithms, PID control algorithms, model predictive control algorithms, etc.) to control actuators 54-58. Actuators 54-58 may receive control signals from AHU controller 44 and may provide feedback signals to AHU controller 44. Feedback signals may include, for example, an indication of a current actuator position, an amount of torque or force exerted by the actuator, diagnostic information (e.g., results of diagnostic tests performed by actuators 54-58), status information, commissioning information, configuration settings, calibration data, and/or other types of information or data that may be collected, stored, or used by actuators 54-58.

Still referring to FIG. 2, AHU 36 is shown to include a cooling coil 68, a heating coil 70, and a fan 66. In some embodiments, cooling coil 68, heating coil 70, and fan 66 are positioned within supply air duct 38. Fan 66 may be configured to force supply air 86 through cooling coil 68 and/or heating coil 70. AHU controller 44 may communicate with fan 66 via communications link 78 to control a flow rate of supply air 86. Cooling coil 68 may receive a chilled fluid from chiller 22 via piping 32 and may return the chilled fluid to chiller 22 via piping 34. Valve 92 may be positioned along piping 32 or piping 34 to control an amount of the chilled fluid provided to cooling coil 68. Heating coil 70 may receive a heated fluid from boiler 24 via piping 32 and may return the heated fluid to boiler 24 via piping 34. Valve 94 may be positioned along piping 32 or piping 34 to control an amount of the heated fluid provided to heating coil 70.

Each of valves 92-94 may be controlled by an actuator. As shown in FIG. 2, valve 92 may be controlled by actuator 88 and valve 94 may be controlled by actuator 90. Actuators 88-90 may communicate with AHU controller 44 via communications links 96-98. Actuators 88-90 may receive control signals from AHU controller 44 and may provide feedback signals to controller 44. In some embodiments, AHU controller 44 receives a measurement of the supply air temperature from a temperature sensor 72 positioned in supply air duct 38 (e.g., downstream of cooling coil 68 and heating coil 70). AHU controller 44 may operate actuators 88-90 to modulate an amount of heating or cooling provided to supply air 86 to achieve a setpoint temperature for supply air 86 or to maintain the temperature of supply air 86 within a setpoint temperature range.

In some embodiments, two or more of actuators 54-58 and/or actuators 88-90 may be arranged in a tandem configuration. For example, one actuator may be arranged as a master actuator (e.g., directly connected with AHU controller 44) and other actuators may be arranged as slave actuators (e.g., connected to a feedback data connection of the master actuator). Such a tandem arrangement is described in greater detail with reference to FIG. 3. Advantageously, each of actuators 54-58 and 88-90 may be configured to automatically determine whether it is arranged as a master actuator, a slave actuator, or not linked to any other actuators. Each of actuators 54-58 and 88-90 may be configured to automatically set its own operating mode (e.g., master, slave, non-linked, etc.) based on the determined arrangement.

Still referring to FIG. 2, HVAC system 20 is shown to include a supervisory controller 42 and a client device 46. Supervisory controller 42 may include one or more computer systems (e.g., servers, BAS controllers, etc.) that serve as enterprise level controllers, application or data servers, head nodes, master controllers, or field controllers for HVAC system 20. Supervisory controller 42 may communicate with multiple downstream building systems or subsystems (e.g., an HVAC system, a security system, etc.) via a communications link 50 according to like or disparate protocols (e.g., LON, BACnet, etc.). In some embodiments, AHU controller 44 receives information (e.g., commands, setpoints, operating boundaries, etc.) from supervisory controller 42. For example, supervisory controller 42 may provide AHU controller 44 with a high fan speed limit and a low fan speed limit. A low limit may avoid frequent component and power taxing fan start-ups while a high limit may avoid operation near the mechanical or thermal limits of the fan system. In various embodiments, AHU controller 44 and supervisory controller 42 may be separate (as shown in FIG. 2) or integrated. In an integrated implementation, AHU controller 44 may be a software module configured for execution by a processor of supervisory controller 42.

Client device 46 may include one or more human-machine interfaces or client interfaces (e.g., graphical user interfaces, reporting interfaces, text-based computer interfaces, client-facing web services, web servers that provide pages to web clients, etc.) for controlling, viewing, or otherwise interacting with HVAC system 20, its subsystems, and/or devices. Client device 46 may be a computer workstation, a client terminal, a remote or local interface, or any other type of user interface device. Client device 46 may be a stationary terminal or a mobile device. For example, client device 46 may be a desktop computer, a computer server with a user interface, a laptop computer, a tablet, a smartphone, a PDA, or any other type of mobile or non-mobile device.

Figure 3:
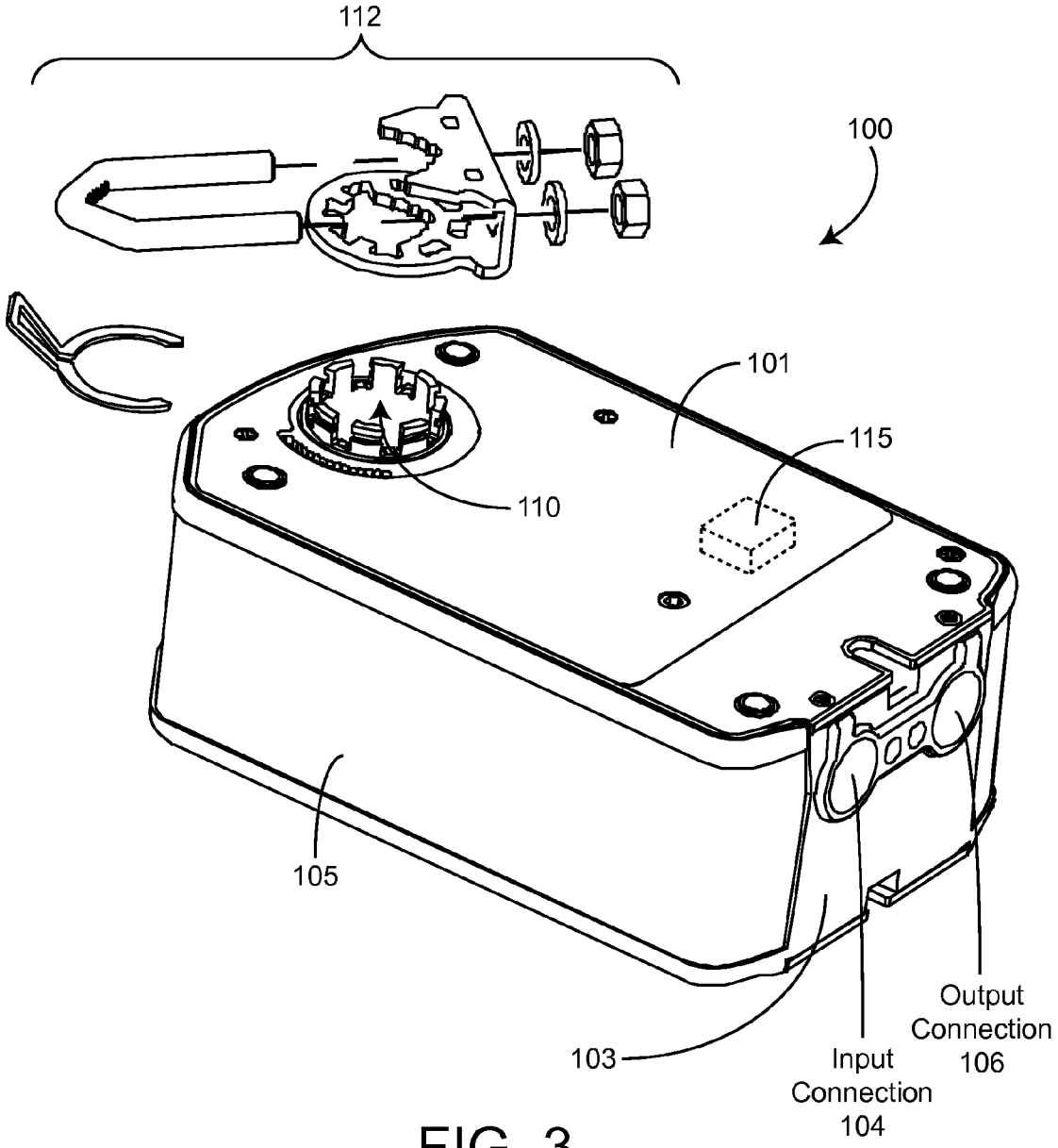
FIG. 3 is a perspective view of an actuator for a HVAC system, according to an exemplary embodiment.
Figure 5:
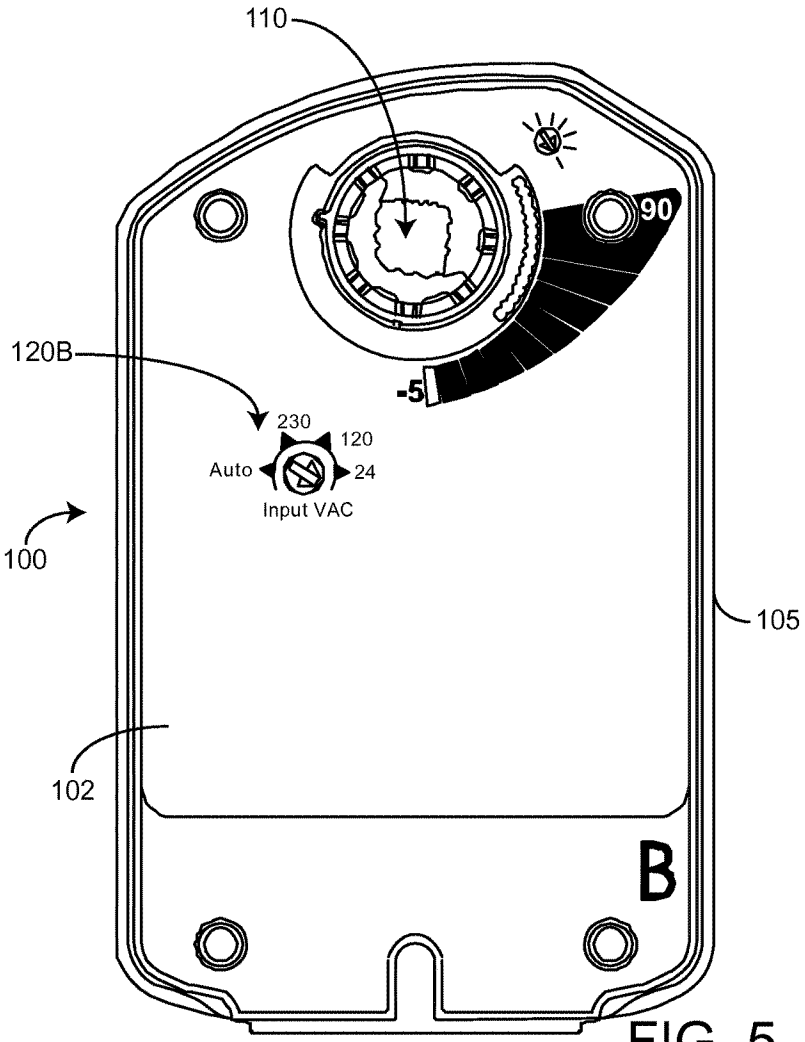
FIG. 5 is a rear view of the actuator of FIG. 3, according to an exemplary embodiment.
Figure 4:
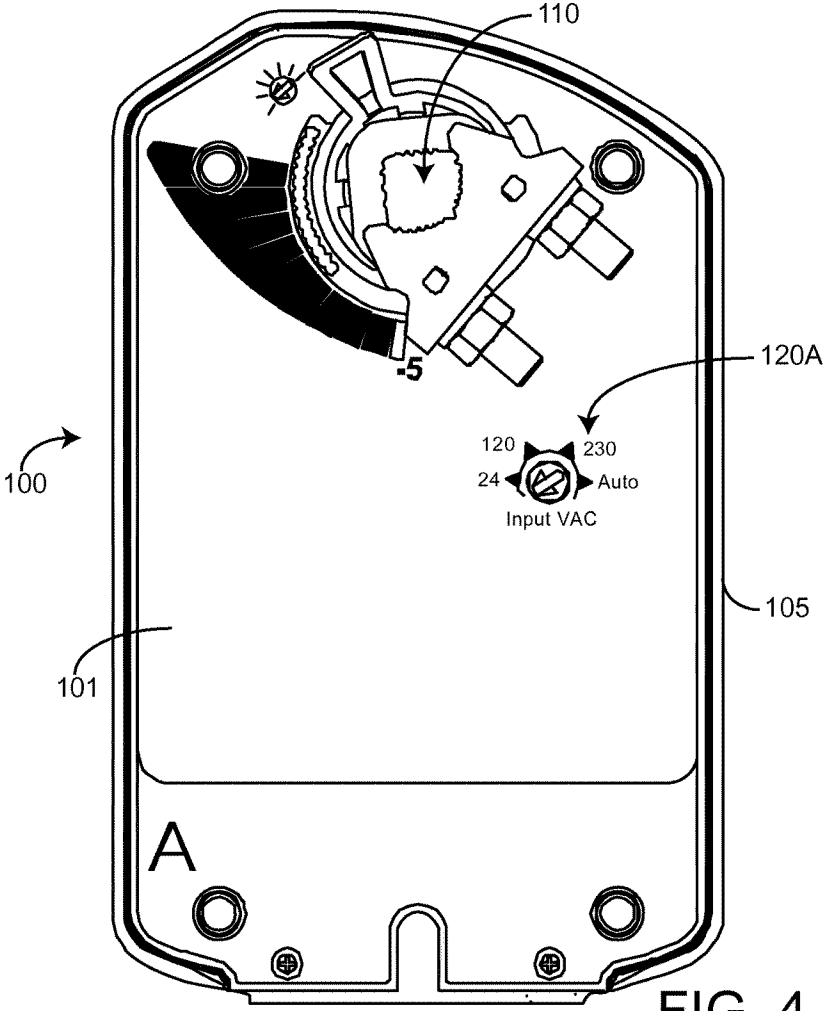
FIG. 4 is a front view of the actuator of FIG. 3, according to an exemplary embodiment.

Referring now to FIGS. 3-5, an actuator 100 for use in a HVAC system is shown, according to an exemplary embodiment. In some implementations, actuator 100 may be used in HVAC system 20, as described with reference to FIGS. 1-2. For example, actuator 100 may be a damper actuator (e.g., one or actuators 54-58), a valve actuator (e.g., one of actuators 88-90), a fan actuator, a pump actuator, or any other type of actuator that can be used in HVAC system 20. In various embodiments, actuator 100 may be a linear proportional actuator, a non-linear actuator, a spring return actuator, and/or a non-spring return actuator.

Actuator 100 is shown to include a drive device 110. Drive device 110 may be a drive mechanism, a hub, or other device configured to drive or effectuate movement of a HVAC system component. For example, drive device 110 may be configured to receive a shaft of a damper (e.g., one of dampers 60-64) or a valve (e.g., one of valves 92-94) in order to drive (e.g., rotate) the shaft. In some embodiments, actuator 100 includes a coupling device 112 configured to aid in coupling drive device 110 to the movable HVAC system component. For example, coupling device 112 may facilitate attaching drive device 110 to a valve or damper shaft.

Still referring to FIGS. 3-5, actuator 100 is shown to include a housing 105 having a first or front side 101 (i.e., side A), a second or rear side 102 (i.e., side B) opposite first side 101, and a bottom 103. Bottom 103 is shown to include an input connection 104 and an output connection 106.

Input connection 104 may be configured to receive an AC voltage signal having a standard power line voltage (e.g., 120 VAC or 230 VAC at 50/60 Hz). In some embodiments, actuator 100 uses the voltage signal as a control signal for drive device 110. For example, the voltage signal may be received from a controller such as an AHU controller (e.g., AHU controller 44), an economizer controller, a supervisory controller (e.g., supervisory controller 42), a zone controller, a field controller, an enterprise level controller, a motor controller, an equipment-level controller (e.g., an actuator controller) or any other type of controller that can be used in HVAC system 20. The frequency of the voltage signal may be modulated by the controller to adjust the rotational speed and/or position of an electric motor coupled to drive device 110 (e.g., for embodiments in which actuator 100 includes a synchronous motor).

In some embodiments, actuator 100 uses the voltage signal to power various components of actuator 100. Actuator 100 may use the AC voltage signal received via input connection 104 as a control signal, a source of electric power, or both. In some embodiments, the voltage signal is received at input connection 104 from a power supply line that provides actuator 100 with an AC voltage having a constant or substantially constant frequency (e.g., 120 VAC or 230 VAC at 50 Hz or 60 Hz). Input connection 104 may include one or more data connections (separate from the power supply line) through which actuator 100 receives control signals from a controller or another actuator (e.g., 0-10 VDC control signals).

In some embodiments, the voltage signal is received at input connection 104 from another actuator. For example, if multiple actuators are interconnected in a tandem arrangement, input connection 104 may be connected (e.g., via a communications bus) to the output data connection of another actuator. One of the actuators may be arranged as a master actuator (e.g., with input connection 104 connected to a controller), whereas other actuators may be arranged as slave actuators (e.g., with their respective input connections connected to the output connection 106 of the master actuator).

Output connection 106 may be configured to provide a feedback signal to a controller of HVAC system 20 (e.g., an AHU controller, an economizer controller, a supervisory controller, a zone controller, a field controller, an enterprise level controller, etc.) to relate the rotational position of actuator 100. In other embodiments, output connection 106 may be configured to provide a control signal to another actuator (e.g., a slave actuator) arranged in tandem with actuator 100. Input connection 104 and output connection 106 may be connected to the controller or the other actuator via a communications bus. The communications bus may be a wired or wireless communications link and may use any of a variety of disparate communications protocols (e.g., BACnet, LON, WiFi, Bluetooth, NFC, TCP/IP, etc.).

Still referring to FIGS. 3-5, actuator 100 is shown to include a user-operable switch 120A/B. First side 101 is shown to include switch 120A (as shown in FIG. 4) and second side 102 is shown to include switch 120B (as shown in FIG. 5). For sake of clarity, the switch 120A/B will be referred to as switch 120 for the remainder of this document. In various embodiments, switch 120 may be accessible on first side 101, second side 102, or both first side 101 and second side 102. [0036] Switch 120 may be a potentiometer or any other type of switch (e.g., a push button switch, a dial, a flappable switch, etc.).

Switch 120 may be operated (e.g., manually by a user) to move switch 120 between and into a plurality of discrete positions. For example, switch 120 is shown to include a "24 VAC" position, a "120 VAC" position, a "230 VAC" position, an "Auto" position. Each position of switch 120 corresponds to a different operating mode. In some embodiments, actuator 100 includes a mechanical transducer (e.g., an electric motor) that requires a predetermined input voltage (e.g., approximately 24 VAC) to operate most effectively. According to other exemplary embodiments, switch 120 may have a greater or lesser number of positions and/or may have modes other than the modes explicitly listed. The different operating modes indicated by switch 120 correspond to different voltage reduction factors applied to the input voltage received at input connection 104 before the input voltage is provided to the mechanical transducer.

With switch 120 in the 24 VAC position, actuator 100 may be configured to accept an input voltage of approximately 24 VAC (e.g., 20-30 VAC) at input connection 104. Moving switch 120 into the 24 VAC position may configure actuator 100 to apply a reduction factor of approximately 1 to the input voltage. For example, actuator 100 may include internal circuitry (e.g., a voltage divider circuit, shown in FIG. 4) configured to divide the input voltage by the reduction factor and to provide the reduced voltage to the mechanical transducer. A reduction factor of 1 (as indicated by the 24 VAC position for switch 120) may configure actuator 100 to provide the input voltage to the mechanical transducer without any voltage reduction.

With switch 120 in the 120 VAC position, actuator 100 may be configured to accept an input voltage of approximately 120 VAC (e.g., 100-140 VAC, 110-130 VAC, etc.) at input connection 104. Moving switch 120 into the 120 VAC position may configure actuator 100 to apply a reduction factor of approximately 5 (e.g., 3-7, 4-6, 4.5-5.5, etc.) to the input voltage. A reduction factor of approximately 5 (as indicated by the 120 VAC position for switch 120) may configure actuator 100 to reduce the input voltage by a factor of 5 (e.g., from approximately 120 VAC to approximately 24 VAC) and to provide the reduced voltage to the mechanical transducer.

With switch 120 in the 230 VAC position, actuator 100 may be configured to accept an input voltage of approximately 230 VAC (e.g., 200-260 VAC, 220-240 VAC, etc.) at input connection 104. Moving switch 120 into the 230 VAC position may configure actuator 100 to apply a reduction factor of approximately 9.6 (e.g., 7-13, 8-12, 9-10, etc.) to the input voltage. A reduction factor of approximately 9.6 (as indicated by the 230 VAC position for switch 120) may configure actuator 100 to reduce the input voltage by a factor of approximately 9.6 (e.g., from approximately 230 VAC to approximately 24 VAC) and to provide the reduced voltage to the mechanical transducer.

With switch 120 in the "Auto" position, actuator 100 may be configured automatically determine the input voltage received at input connection 104 and to adjust the voltage reduction factor accordingly. For example, actuator 100 may include a voltage sensor positioned to measure the input voltage received at input connection 104. Actuator 100 may calculate the appropriate reduction factor to reduce the measured input voltage to the predetermined input voltage for the mechanical transducer (e.g., by dividing the measured input voltage by the predetermined input voltage). Actuator 100 may automatically configure an internal voltage reduction circuit to apply the calculated reduction factor to the input voltage received at input connection 104.

Figure 6:
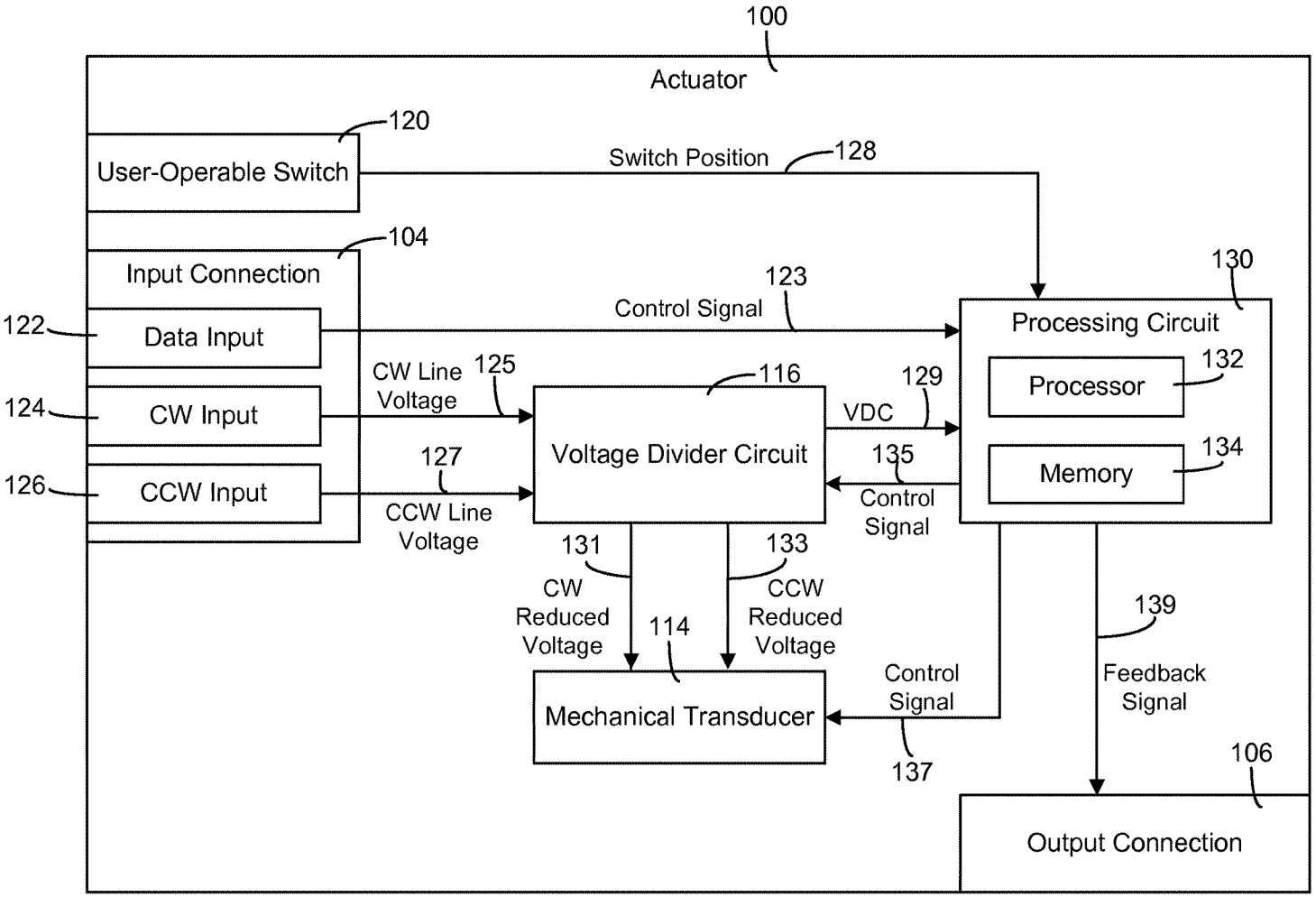
FIG. 6 is a block diagram illustrating the actuator of FIG. 3 in greater detail and showing a voltage reduction circuit configured to reduce an input power line voltage to a reduced voltage within the actuator, according to an exemplary embodiment.

Referring now to FIG. 6, a block diagram of actuator 100 is shown, according to an exemplary embodiment. Actuator 100 is shown to include an input connection 104, an output connection 106, a user-operable switch 120, a mechanical transducer 114, a voltage divider circuit 116, and a processing circuit 130. Input connection 104 and output connection 106 may be part of a communications interface for actuator 100. For example, input connection 104 and output connection 106 may include wired or wireless interfaces (e.g., jacks, antennas, transmitters, receivers, transceivers, wire terminals, etc.) for conducting data communications with various systems, devices, or networks.

In some embodiments, input connection 104 and output connection 106 are connected to a communications bus. The communications bus may be a wired or wireless communications link and may use any of a variety of disparate communications protocols (e.g., BACnet, LON, WiFi, Bluetooth, NFC, TCP/IP, etc.). Connections 104-106 can include an Ethernet card or port for sending and receiving data via an Ethernet-based communications network. Connections 104-106 may include a wireless transceiver (e.g., a WiFi transceiver, a NFC transceiver, a Bluetooth transceiver, a cellular transceiver, a RFID transceiver, an optical transceiver, etc.) for communicating via a wireless communications network. Connections 104-106 may be configured to communicate via local area networks or wide area networks (e.g., the Internet, a building WAN, etc.).

Input connection 104 is shown to include a data input 122, a clockwise (CW) input 124, and a counter-clockwise (CCW) input 126. Data input 122 may be configured to receive a control signal 123 (e.g., from a controller or another actuator) and to communicate the control signal to processing circuit 130. In some embodiments, control signal 123 is a pulse width modulated DC voltage signal.

CW input 124 and CCW input 126 may be configured to AC voltage signals (e.g., from a controller, another actuator, or a power supply line) and to communicate the AC voltage signals to voltage divider circuit 116. The AC voltage signals received via inputs 124-126 may have a power supply line voltage (e.g., 120 VAC or 230 VAC at 50/60 Hz). CW input 124 may receive and communicate a CW line voltage 125 for driving mechanical transducer 114 in a first direction (e.g., clockwise). CCW input 126 may receive and communicate a CCW line voltage 127 for driving mechanical transducer 114 in a second direction (e.g., counter-clockwise) opposite the first direction.

Still referring to FIG. 6, actuator 100 is shown to include a voltage divider circuit 116. Voltage divider circuit 116 may be configured to receive CW line voltage 125 and CCW line voltage 127 from input connection 104. Voltage divider circuit 116 may include one or more circuit elements (e.g., capacitors, switches, etc.) configured to apply a reduction factor to line voltages 125 and 127, thereby producing CW reduced voltage 131 and CCW reduced voltage 133. For example, voltage divider circuit 116 include one or more capacitors configured to introduce an electrical impedance between input connection 104 and mechanical transducer 114. The electrical impedance may cause voltage divider circuit 116 to reduce line voltages 125 and 127 to reduced voltages 131 and 133. Reduced voltages 131 and 133 may have a voltage value of approximately 24 VAC and may be provided to mechanical transducer 114

In some embodiments, the capacitors have a capacitance value based on an electrical impedance of mechanical transducer 114. The impedance of mechanical transducer 114 may be a function of the electrical inductance and/or the electrical resistance provided by mechanical transducer 114. In some embodiments, voltage divider circuit 116 determines the impedance of mechanical transducer 114 and uses the impedance of mechanical transducer 114 to calculate an impedance required to reduce line voltages 125 and 127 to reduced voltages 131 and 133. Voltage divider circuit 116 may automatically adjust the impedance between input connection 104 and mechanical transducer 114 to achieve the reduced voltages 131 and 133 (e.g., based on switch position 128 and/or a control signal 135 provided by processing circuit 130 or data input 122).

In some embodiments, voltage divider circuit 116 includes multiple capacitors arranged in parallel between input connection 104 and mechanical transducer 114. Voltage divider circuit 116 may include a switch that is operable to connect and/or disconnect one or more of the capacitors from voltage divider circuit 116. Operating the switch may adjust a capacitance between input connection 104 and mechanical transducer 114, thereby affecting the impedance and corresponding voltage reduction provided by voltage divider circuit 116. The switch may be operated by a user (e.g., via switch 120) or by voltage reduction circuit 116 (e.g., automatically based on control signal 135). In some embodiments, voltage divider circuit 116 is configured to measure the line voltage received at input connection 104 and/or voltage divider circuit 116 and to adjust an impedance between input connection 104 and mechanical transducer 114 (e.g., by operating the switch, by connecting or disconnecting capacitors or other circuit elements, etc.) based on the measured line voltage.

Still referring to FIG. 6, actuator 100 is shown to include a mechanical transducer 114. Mechanical transducer 114 may be any apparatus capable of providing forces and/or motion in response to a control signal. For example, transducer 114 may be any of a variety of mechanical transducers such as rotary motors, linear motors, hydraulic or pneumatic pistons/motors, piezoelectric elements, relays, comb drives, thermal bimorphs, or other similar devices to provide mechanical motion. Transducer 114 may provide any combination of linear, curved, or rotary forces/motion.

In some embodiments, transducer 114 is connected with one or more mechanical components (e.g., gears, pulleys, cams, screws, levers, crankshafts, ratchets, etc.) capable of changing or affecting the motion provided by transducer 114. In some embodiments, transducer 114 may not produce significant motion in operation. For example, transducer 114 may be operated to exert a force or torque to an external element (e.g., a holding force) without affecting significant linear or rotary motion.

Mechanical transducer 114 may be operated by a control signal 137 received from processing circuit 130 or by a reduced voltage control signal (e.g., CW reduced voltage 131 or CCW reduced voltage 133) received from voltage divider circuit 116. electrically coupled to the processing circuit 130. Transducer 114 may be electrically coupled to voltage divider circuit 116 and/or processing circuit 130. Transducer 114 may be physically coupled to drive device 110 to drive a damper or other component of HVAC system 20.

Still referring to FIG. 6, processing circuit 130 is shown to include a processor 132 and memory 134. Processor 132 may be a general purpose or specific purpose processor, an application specific integrated circuit (ASIC), one or more field programmable gate arrays (FPGAs), a group of processing components, or other suitable processing components. Processor 132 may be configured to execute computer code or instructions stored in memory 134 or received from other computer readable media (e.g., CDROM, network storage, a remote server, etc.).

Memory 134 may include one or more devices (e.g., memory units, memory devices, storage devices, etc.) for storing data and/or computer code for completing and/or facilitating the various processes described in the present disclosure. Memory 134 may include random access memory (RAM), read-only memory (ROM), hard drive storage, temporary storage, non-volatile memory, flash memory, optical memory, or any other suitable memory for storing software objects and/or computer instructions. Memory 134 may include database components, object code components, script components, or any other type of information structure for supporting the various activities and information structures described in the present disclosure. Memory 134 may be communicably connected to processor 132 via processing circuit 130 and may include computer code for executing (e.g., by processor 132) one or more processes described herein.

In some embodiments, processing circuit 130 functions as a motor control and time out circuit for actuator 100. Processing circuit 130 may be configured to receive a control signal 123 from a controller or another actuator via data input 122. Processing circuit 130 may receive power (e.g., DC voltage 129) from voltage divider circuit 116. Processing circuit 130 may generate a control signal 135 for voltage divider circuit 116. Control signal 135 may cause voltage divider circuit 116 to connect or disconnect various capacitors or other circuit elements to adjust an impedance provided by voltage divider circuit 116.

In some embodiments, processing circuit 130 calculates the required impedance for voltage divider circuit 116 based on switch position 128 and/or a measurement of line voltages 125 or 127. The required impedance may be the impedance that results in voltage divider circuit 116 reducing line voltages 125 and 127 to a predetermined input voltage for mechanical transducer 114 (e.g., approximately 24 VAC). The calculations and control operations performed by processing circuit 130 are described in greater detail with reference to FIGS. 7A-7B.

Figure 7A:
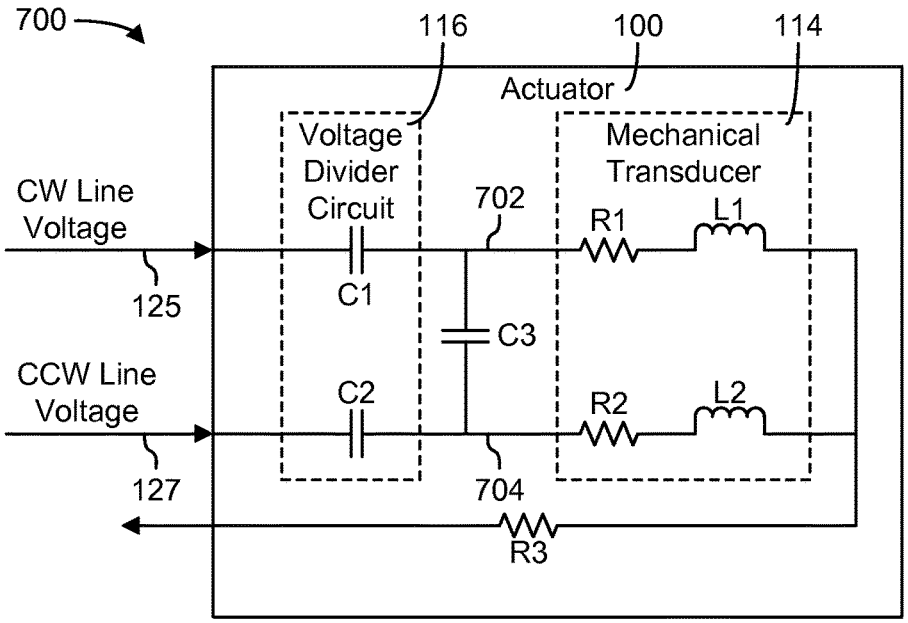
FIG. 7A is simplified circuit diagram illustrating the voltage reduction circuit of FIG. 6 in greater detail, according to a first exemplary embodiment.
Figure 7B:
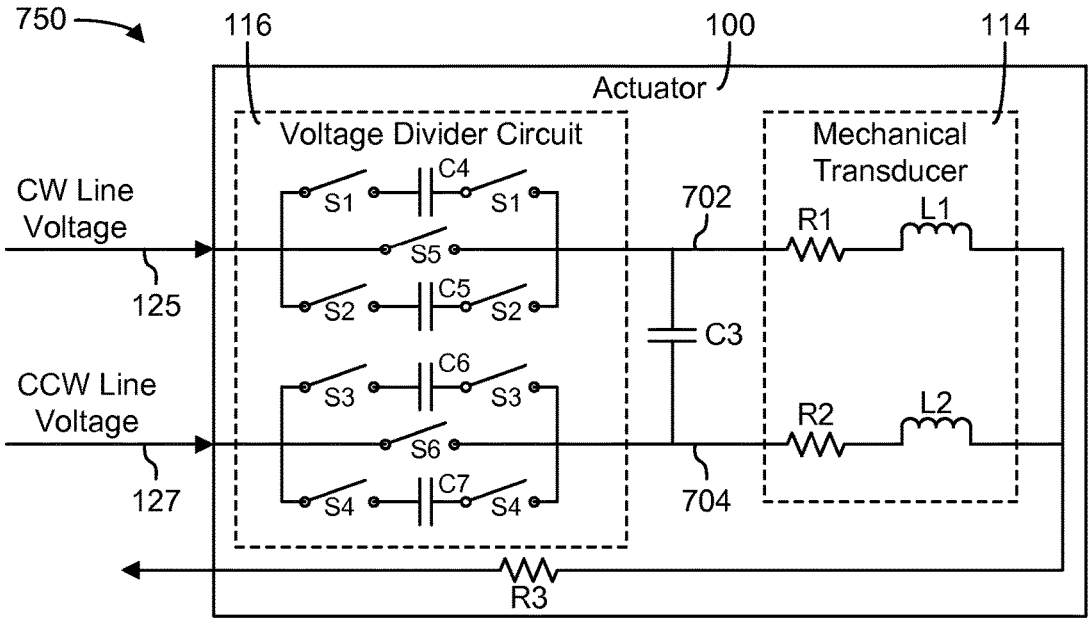
FIG. 7B is simplified circuit diagram illustrating the voltage reduction circuit of FIG. 6 in greater detail, according to a second exemplary embodiment.

Referring now to FIGS. 7A-7B, simplified circuit diagrams 700 and 750 of actuator 100 are shown, according to an exemplary embodiment. Circuit diagram 700 illustrates various circuit elements (e.g., inductors, resistors, capacitors, etc.) that may be included in voltage divider circuit 116, mechanical transducer 114, or otherwise within actuator 100. Circuit diagram 750 illustrates a more complex arrangement of circuit elements including switches (e.g., user-operable switches, electronic relays, etc.) that may be used to connect or disconnect one or more capacitors from voltage divider circuit 116.

Referring specifically to FIG. 7A, voltage divider circuit 116 is shown to include a first capacitor $C_1$ and a second capacitor $C_2$. Capacitor $C_1$ may be arranged between CW input 124 and mechanical transducer 114 such that one side of capacitor $C_1$ receives CW line voltage 125 and the other side of capacitor $C_1$ is electrically connected with an input of mechanical transducer 114. Capacitor $C_2$ may be arranged between CCW input 126 and mechanical transducer 114 such that one side of capacitor $C_2$ receives CCW line voltage 127 and the other side of capacitor $C_2$ is electrically connected with an input of mechanical transducer 114.

Mechanical transducer 114 is shown as a simplified RL circuit including a first resistor $R_1$, a first inductor $L_1$, a second resistor $R_2$, and a second inductor $L_2$. Resistor $R_1$ and inductor $L_1$ may be arranged in series with capacitor $C_1$ along a first parallel path 702. First parallel path 702 may carry the CW input signal through actuator 100. Resistor $R_2$ and inductor $L_2$ may be arranged in series with capacitor $C_2$ along a second parallel path 704. Second parallel path 704 may carry the CCW input signal through actuator 100. Actuator 100 is shown to further include a current limiting resistor $R_3$ in series with mechanical transducer 114 and a third capacitor $C_3$ bridging parallel paths 702 and 704 between voltage divider circuit 116 and mechanical transducer 114.

In some embodiments, processing circuit 130 calculates an electrical impedance associated with mechanical transducer 114 and current limiting resistor $R_3$ along first parallel path 702 and/or second parallel path 704. The electrical impedance associated mechanical transducer 114 along parallel path 702 can be calculated by adding the electrical impedances associated with resistor $R_1$ and inductor $L_1$. The impedance $Z_{R1}$ of resistor $R_1$ is the resistance value of resistor $R_1$, measured in Ohms (i.e., $Z_{R1}=R_1$). A formula for calculating the impedance $Z_{L1}$ of inductor $L_1$ is provided below:

$$Z_{L1}=2\pi f L_1$$

where f is the frequency of CW line voltage 125 and $L_1$ is the inductance value of inductor $L_1$. The impedance $Z_{R3}$ of current limiting resistor $R_3$ is the resistance value of resistor $R_3$, measured in Ohms (i.e., $Z_{R3}=R_3$). The impedance $Z_{CW}$ along path 702 provided by mechanical transducer 114 and current limiting resistor $R_3$ can be expressed as follows:

$$Z_{CW}=Z_{R1}+Z_{L1}+Z_{R3}.$$

The electrical impedance associated mechanical transducer 114 along parallel path 704 can be calculated by adding the electrical impedances associated with resistor $R_2$ and inductor $L_2$. The impedance $Z_{R2}$ of resistor $R_2$ is the resistance value of resistor $R_2$, measured in Ohms (i.e., $Z_{R2}=R_2$). A formula for calculating the impedance $Z_{L2}$ of inductor $L_2$ is provided below:

$$Z_{L2}=2\pi f L_2$$

where f is the frequency of CCW line voltage 127 and $L_2$ is the inductance value of inductor $L_2$. The impedance $Z_{CCW}$ along path 704 provided by mechanical transducer 114 and current limiting resistor $R_3$ can be expressed as follows:

$$Z_{CCW}=Z_{R2}+Z_{L2}+Z_{R3}.$$

The impedance $Z_{C1}$ provided by capacitor $C_1$ can be calculated using the following equation:

$$Z_{C1} = \frac{1}{2\pi f C_1}$$

where f is the frequency of CW line voltage 125 and $C_1$ is the capacitance value of capacitor $C_1$. Similarly, the impedance $Z_{C2}$ provided by capacitor $C_2$ can be calculated using the following equation:

$$Z_{C2} = \frac{1}{2\pi f C_2}$$

where f is the frequency of CCW line voltage 127 and $C_2$ is the capacitance value of capacitor $C_2$.

In some embodiments, the capacitance values of capacitors $C_1$ and/or $C_2$ are based on the electrical impedance provided by mechanical transducer 114, which is a function of the inductance of mechanical transducer 114. For example, the capacitance values of capacitors $C_1$ and/or $C_2$ may be selected such that the extra impedance provided by capacitors $C_1$ and/or $C_2$ reduces line voltages 125 and 127 to a predetermined input voltage $V_{reduced}$ (e.g., approximately 24 VAC) between voltage divider circuit 116 and mechanical transducer 114.

The amount by which line voltages 125 and 127 are reduced may be a function of the ratio between the impedances provided by voltage divider circuit 116 and the total impedance along parallel paths 702 and or 704. For example, the reduced voltage $V_{reduced,1}$ between capacitor $C_1$ and mechanical transducer 114 can be calculated using the following equation:

$$V_{reduced,1} = V_{line,CW} \times \left(\frac{Z_{CW}}{Z_{C1} + Z_{CW}}\right)$$

where $V_{line,CW}$ is the CW line voltage 125. Similarly, the reduced voltage $V_{reduced,2}$ between capacitor $C_2$ and mechanical transducer 114 can be calculated using the following equation:

$$V_{reduced,2} = V_{line,CCW} \times \left(\frac{Z_{CCW}}{Z_{C2} + Z_{CCW}}\right)$$

where $V_{line,CCW}$ is the CCW line voltage 127.

In one exemplary embodiment, line voltages 125 and 127 are approximately 230 VAC at 50 Hz (i.e., $V_{line,CW}=V_{line,CCW}=230$, and f=50), mechanical transducer 114 has a resistance of approximately 200Ω (i.e., $R_1=R_2=200$) and an inductance of approximately 87 mH (i.e., $L_1=L_2=0.087$), and current limiting resistor $R_3$ has a resistance of approximately 10Ω (i.e., $R_3=10$).

When line voltages 125 and 127 are approximately 230 VAC at 50 Hz, capacitors $C_1$ and $C_2$ may be selected to have capacitance values of approximately 1.5 μF (i.e., $C_1=C_2=1.5$ μF). Plugging these values into the equations provided above results in the following impedance values:

$$Z_{R1}=Z_{R2}=200\ \Omega$$

$$Z_{R3}=10\Omega$$

$$Z_{L1}=Z_{L2}=27.33\Omega$$

$$Z_{C1}=Z_{C2}=2.12\ \Omega$$

which results in $V_{reduced,1}=V_{reduced,2}=23.14$ VAC. When line voltages 125 and 127 are approximately 230 VAC at 60 Hz, the 1.5 μF values for capacitors results in $V_{reduced,1}=V_{reduced,2}=27.87$ VAC.

Subsequent calculations can be performed to determine $V_{reduced,1}$ and $V_{reduced,2}$ when line voltages 125 and 127 are 120 VAC at 50/60 Hz. When line voltages 125 and 127 are approximately 120 VAC at 50 Hz, capacitors $C_1$ and $C_2$ may be selected to have capacitance values of approximately 3.3 μF (i.e., $C_1=C_2=3.3$ μF). Plugging these values into the equations provided above results in $V_{reduced,1}=V_{reduced,2}=23.70$ VAC. When line voltages 125 and 127 are approximately 120 VAC at 60 Hz, the 3.3 μF values for capacitors results in $V_{reduced,1}=V_{reduced,2}=27.93$ VAC.

In some embodiments, the capacitance values for capacitors $C_1$ and $C_2$ are based on the line voltages 125 and 127 provided to actuator 100. For example, if actuator 100 receives a line voltage of approximately 230 VAC, capacitors $C_1$ and $C_2$ may be selected to have capacitance values of approximately 1.5 μF. If actuator 100 receives a line voltage of approximately 120 VAC, capacitors $C_1$ and $C_2$ may be selected to have capacitance values of approximately 3.3 μF. The capacitance values for capacitors $C_1$ and $C_2$ can be selected or adjusted by operating user-operable switch 120 or by swapping one set of capacitors for a different set of capacitors (e.g., during manufacturing, during maintenance, etc.).

Referring specifically to FIG. 7B, a simplified circuit diagram 750 of actuator 100 is shown, according to an exemplary embodiment. In circuit diagram 750, voltage divider circuit 116 is shown to include multiple capacitors arranged in parallel along each of paths 702 and 704. For example, path 702 is shown to include capacitors $C_4$ and $C_5$ arranged in parallel, and path 704 is shown to include capacitors $C_6$ and $C_7$ arranged in parallel. In some embodiments, capacitors $C_4$ and $C_6$ have capacitance values of approximately 1.5 μF. Capacitors $C_5$ and $C_7$ may have capacitance values of approximately 1.8 μF. When both of capacitors $C_4$ and $C_5$ are connected along parallel path 702, the total capacitance along parallel path 702 may be approximately 3.3 μF. Similarly, When both of capacitors $C_6$ and $C_7$ are connected along parallel path 704, the total capacitance along parallel path 704 may be approximately 3.3 μF. Capacitors $C_4$-$C_7$ may be connected or disconnected from voltage divider circuit 116 to adjust the amount of capacitance provided.

Capacitor $C_4$ can be connected or disconnected from voltage divider circuit 116 by opening and closing one or both of switches $S_1$ arranged in series with capacitor $C_4$. One or both of switches $S_1$ may be present in various implementations. Similarly, capacitors $C_5$, $C_6$, and $C_7$ can be connected or disconnected from voltage divider circuit 116 by operating switches $S_2$, $S_3$, and $S_4$, respectively. Switches $S_5$ and $S_6$ can be operated to allow CW line voltage 125 and CCW line voltage 127 to pass through voltage divider circuit 116 without substantial voltage reduction.

In some embodiments, switches $S_1$-$S_5$ are electronic switches or relays controlled by processing circuit 130. Processing circuit 130 may operate switches $S_1$-$S_5$ based the position of user-operable switch 120 as indicated by switch position input 128 and/or a measured value of line voltages 125 and 127. For example, if user-operable switch 120 is moved into the "24 VAC" position (shown in FIGS. 4-5), processing circuit 130 may open switches $S_1$-$S_4$ and close switches $S_5$-$S_6$, thereby allowing line voltages 125 and 127 to pass through voltage divider circuit 120 without substantial voltage reduction.

If user-operable switch 120 is moved into the "120 VAC" position, processing circuit 130 may open switches $S_5$-$S_6$ and close switches $S_1$-$S_4$. Opening switches $S_5$-$S_6$ and closing switches $S_1$-$S_4$ may connect all of capacitors $C_4$-$C_7$, thereby causing the total capacitance along each of paths 702-704 to be approximately 3.3 μF. As discussed above, a capacitance value of approximately 3.3 μF may reduce line voltages 125 and 127 from approximately 120 VAC to approximately 24 VAC.

If user-operable switch 120 is moved into the "230 VAC" position, processing circuit 130 may open switches $S_2$ and $S_4$-$S_6$ and close switches $S_1$ and $S_3$. Opening switches $S_2$ and $S_4$-$S_6$ and closing switches $S_1$ and $S_3$ may cause only capacitors $C_4$ and $C_6$ to be connected, thereby causing the total capacitance along each of paths 702-704 to be approximately 1.5 μF. As discussed above, a capacitance value of approximately 1.5 μF may reduce line voltages 125 and 127 from approximately 230 VAC to approximately 24 VAC.

If user-operable switch 120 is moved into the "Auto" position, processing circuit 130 may measure the voltage of CW line voltage 125 and/or CCW line voltage 127. If the measured line voltage is approximately 24 VAC, processing circuit 130 may open switches $S_1$-$S_4$ and close switches $S_5$-$S_6$, thereby allowing line voltages 125 and 127 to pass through voltage divider circuit 120 without substantial voltage reduction. If the measured line voltage is approximately 120 VAC, processing circuit 130 may open switches $S_5$-$S_6$ and close switches $S_1$-$S_4$, thereby setting the capacitance of voltage divider circuit 116 to 3.3 μF and causing the line voltage to be reduced from approximately 120 VAC to approximately 24 VAC. If the measured line voltage is approximately 230 VAC, processing circuit 130 may open switches $S_2$ and $S_4$-$S_6$ and close switches $S_1$ and $S_3$, thereby setting the capacitance of voltage divider circuit 116 to 1.5 μF and causing the line voltage to be reduced from approximately 230 VAC to approximately 24 VAC.

Figure 8:
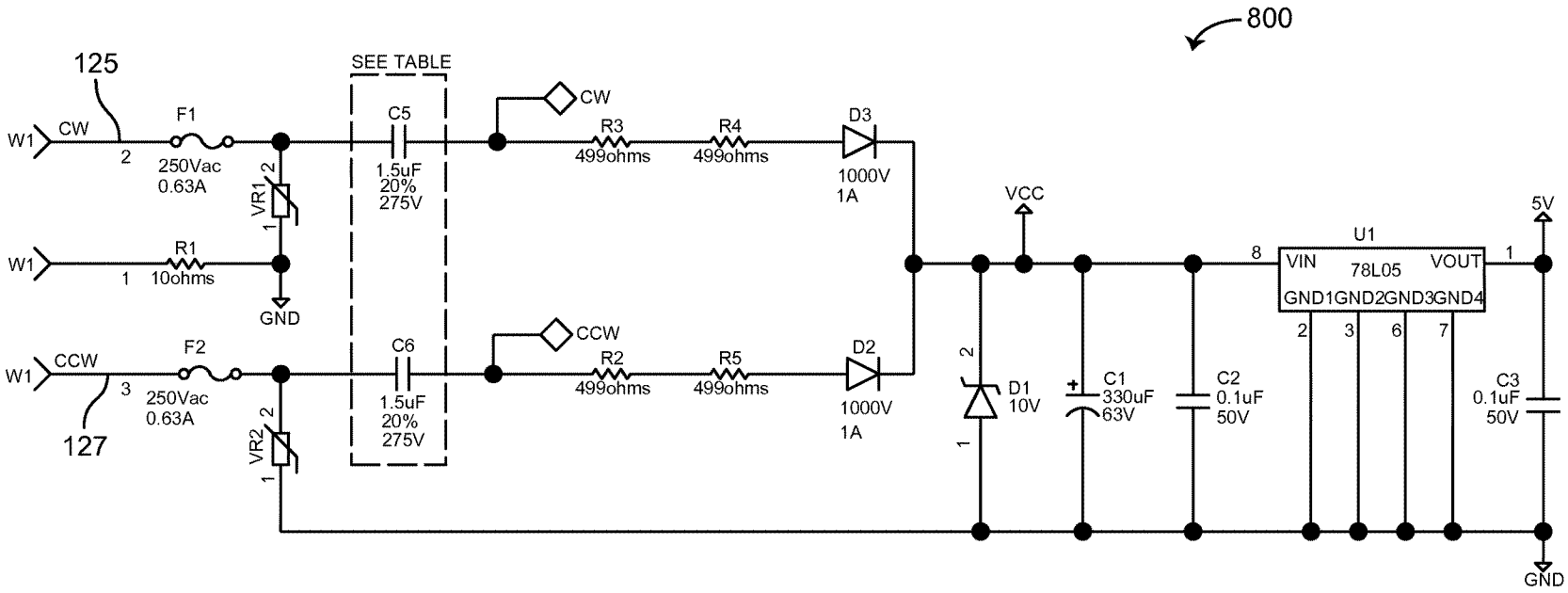
FIG. 8 is a detailed circuit diagram illustrating the voltage reduction circuit of FIG. 6, according to an exemplary embodiment.

Referring now to FIG. 8, a circuit diagram 800 for voltage divider circuit 116 is shown, according to an exemplary embodiment. Circuit diagram 800 is a more detailed version of circuit diagrams 700 and 750, as described with reference to FIGS. 7A-7B. In circuit diagram 800, voltage divider circuit 116 is shown receiving CW line voltage 125 and CCW line voltage 127. In some embodiments, actuator 100 includes one or more fuses (e.g., fuses $F_1$ and $F_2$) between input connection 104 and voltage divider circuit 116. Actuator 100 is shown to include a variety of circuit elements (e.g., resistors, diodes, capacitors, fuses, microprocessors, etc.) that may facilitate the voltage reduction performed by voltage reduction circuit 116.

Voltage divider circuit 116 is shown to include capacitors $C_5$ and $C_6$. The capacitance values for capacitors $C_5$ and $C_6$ may be based on the value of the input voltage $V_{tin}$ for line voltages 125 and 127. If line voltages 125 and 127 are approximately 230 VAC, capacitors $C_5$ and $C_6$ may have capacitance values of approximately 3.3 μF. If line voltages 125 and 127 are approximately 120 VAC, capacitors $C_5$ and $C_6$ may have capacitance values of approximately 1.5 μF. The capacitance values for capacitors $C_5$ and $C_6$ may be adjusted by operating user-operable switch 120 and/or by processing circuit 130 (e.g., by operating one or more electronic switches or relays). The capacitance values for capacitors $C_5$ and $C_6$ may be based on the electrical impedance and/or inductance of mechanical transducer 114.

Figure 9:
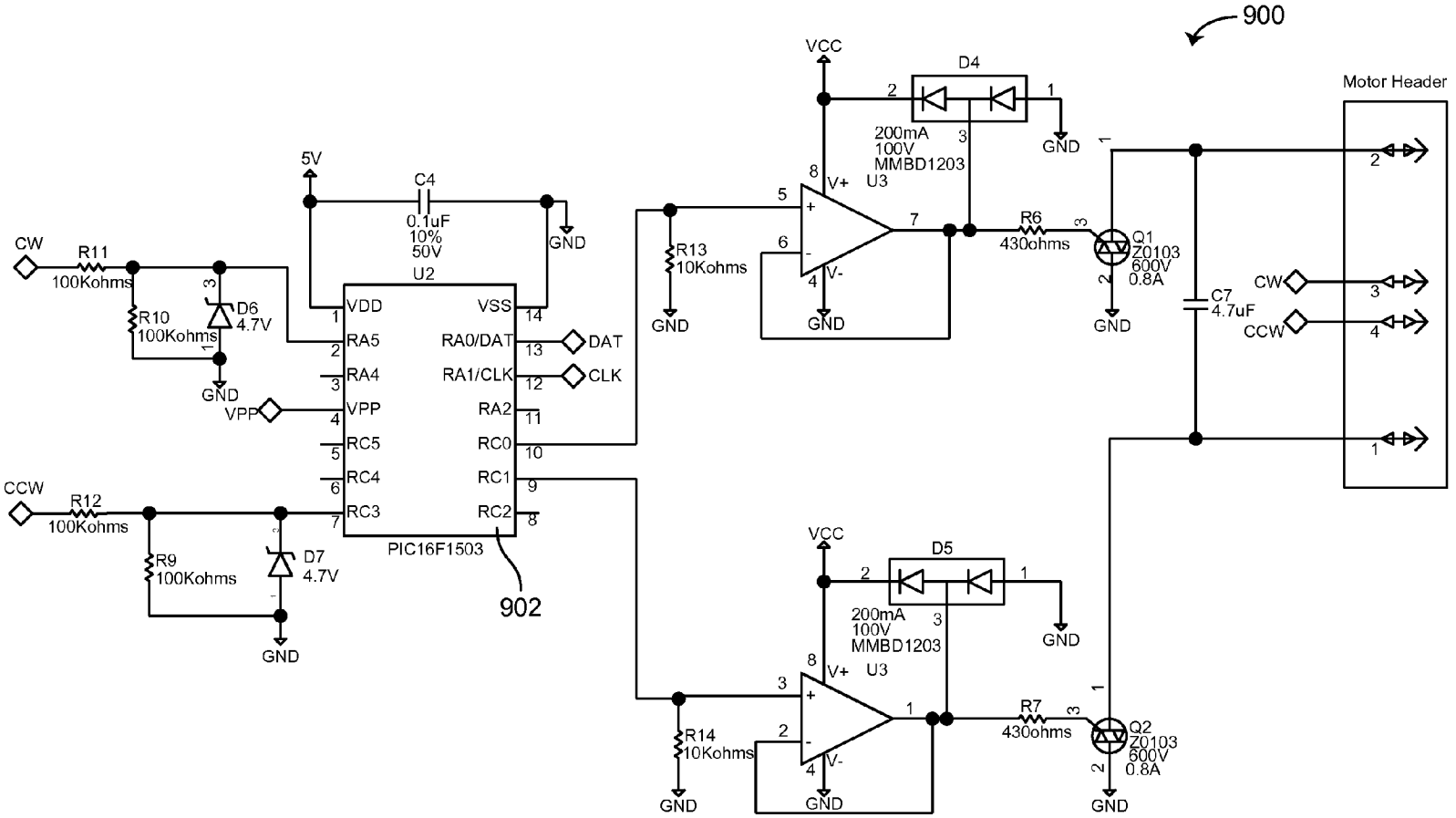
FIG. 9 is a circuit diagram illustrating a time out circuit that may be included in the actuator of FIG. 3, according to an exemplary embodiment.

Referring now to FIG. 9, a circuit diagram for time out circuitry 900 is shown, according to an exemplary embodiment. Time out circuitry 900 may include one or more microprocessors 902 or other circuit elements (e.g., diodes, amplifiers, triads, capacitors, etc.) configured to provide a control signal for mechanical transducer 114. For example, time out circuitry 900 may implement a time out function that removes a control signal from mechanical transducer 114 when a movable component operated by mechanical transducer 114 (e.g., a rotatable shaft or coupling) has reached the end of its path. In various embodiments, time out circuitry 900 may be implemented as part of processing circuit 130 or as a separate circuit.

Time out circuitry 900 may receive a reduced voltage (e.g., 5 VDC) from voltage divider circuit 116. In some embodiments, voltage divider circuit 116 provides a voltage of approximately 24 VAC to mechanical transducer 114 and a separate reduced voltage of approximately 5 VDC to time out circuitry 900.

Figure 10:
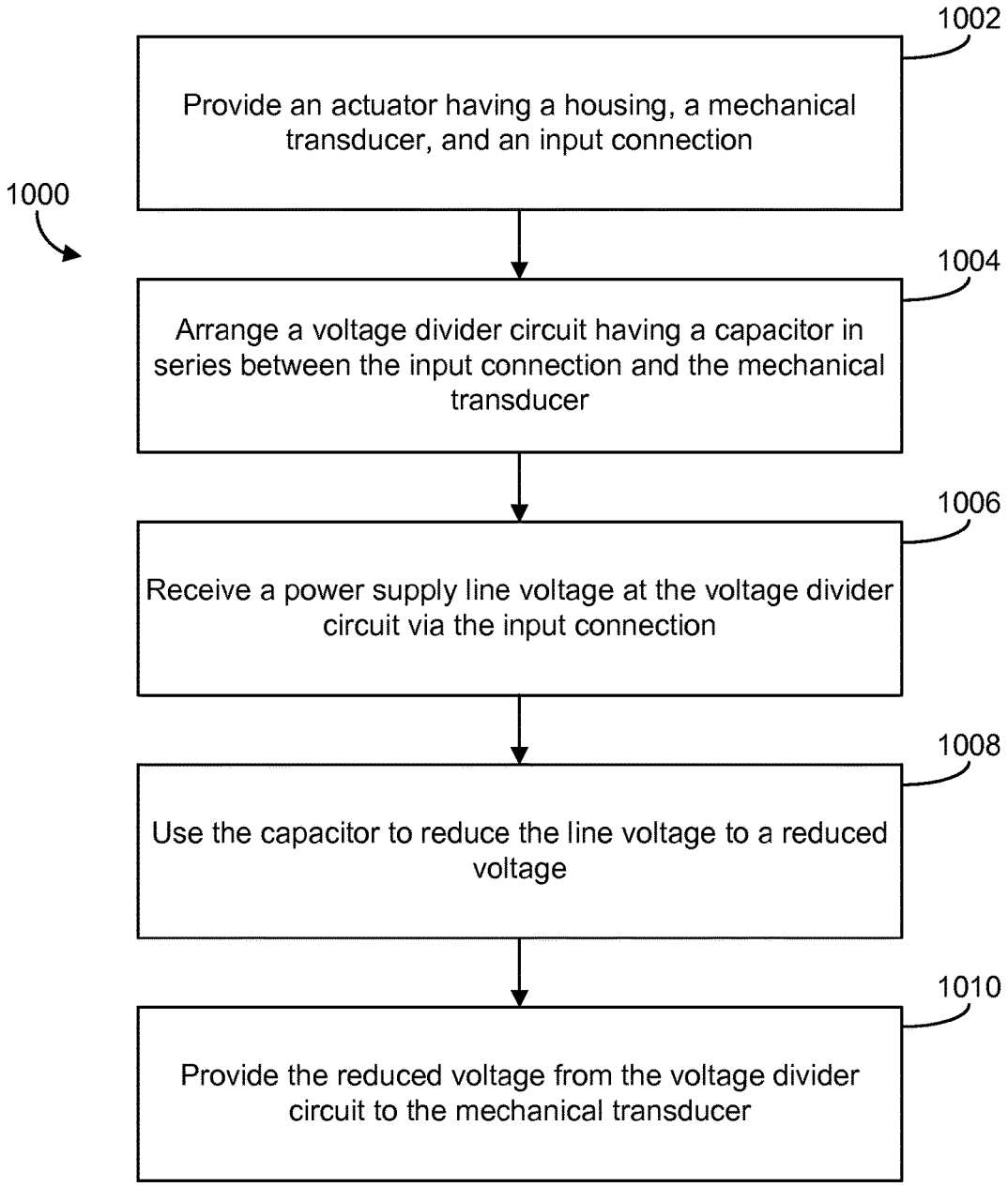
FIG. 10 is a flowchart of a process for operating an actuator in a HVAC system using a power line voltage, according to an exemplary embodiment.

Referring now to FIG. 10, a flowchart of a process 1000 for operating an actuator in a HVAC system using a power line voltage is shown, according to an exemplary embodiment. Process 1000 is shown to include providing an actuator having a housing, a mechanical transducer, and an input connection (step 1002). The input connection may include one or more interfaces (e.g., a data input interface, a CW input interface, a CCW input interface, etc.) configured to receive a voltage signal having a power supply line voltage. The power supply line voltage may be, for example, approximately 120 VAC or approximately 230 VAC at 50 or 60 Hz.

Process 1000 is shown to include arranging a voltage divider circuit having a capacitor in series between the input connection and the mechanical transducer (step 1004). In various embodiments, the voltage divider circuit is located within the housing of the actuator or within an adaptor configured to attach to the housing of the actuator.

The capacitor may have a capacitance value based on an electrical impedance of the mechanical transducer. For example, the capacitor may be selected from a set of multiple capacitors that could potentially be used in the actuator based on the impedance of the mechanical transducer. In some embodiments, the capacitor is selected based on the electrical inductance and/or resistance of the mechanical transducer. In some embodiments, the capacitor is selected based on the voltage value and/or frequency of the line voltage.

Step 1004 may include measuring the line voltage and determining a required capacitance value for the capacitor based on the measured line voltage. The required capacitance value may be a capacitance that results in an impedance sufficient to reduce the line voltage to a predetermined input voltage for the reduced voltage (e.g., approximately 24 VAC). Step 1004 may include adjusting the capacitance to control the impedance between the input connection and the mechanical transducer based on the measured line voltage.

In some embodiments, step 1004 includes determining an impedance of the mechanical transducer, using the impedance of the mechanical transducer and the measured line voltage to calculate an impedance required to reduce the line voltage to the reduced voltage, and adjusting the impedance between the input connection and the mechanical transducer to achieve the reduced voltage. The impedance between the input connection and the mechanical transducer may be adjusted by connecting or disconnecting one or more capacitors (e.g., using a user-operable switch, using an automatically-controlled relay, etc.).

Still referring to FIG. 10, process 1000 is shown to include receiving a power supply line voltage at the voltage divider circuit via the input connection (step 1006), using the capacitor to reduce the line voltage to a reduced voltage (step 1008), and providing the reduced voltage from the voltage divider circuit to the mechanical transducer (step 1010). Advantageously, the voltage reduction may be performed by actuator 100 without requiring any external transformers or switching power supplies to provide the actuators with the required input voltage. The actuator may accept a standard power supply line voltage, reduce the line voltage to a predetermined voltage value (e.g., approximately 24 VAC) and provide the reduced voltage to the mechanical transducer.

Embodiments of the subject matter and the operations described in this specification can be implemented in digital electronic circuitry, or in computer software embodied on a tangible medium, firmware, or hardware, including the structures disclosed in this specification and their structural equivalents, or in combinations of one or more of them. Embodiments of the subject matter described in this specification can be implemented as one or more computer programs, i.e., one or more modules of computer program instructions, encoded on one or more computer storage medium for execution by, or to control the operation of, data processing apparatus. Alternatively or in addition, the program instructions can be encoded on an artificially-generated propagated signal, e.g., a machine-generated electrical, optical, or electromagnetic signal, that is generated to encode information for transmission to suitable receiver apparatus for execution by a data processing apparatus. A computer storage medium can be, or be included in, a computer-readable storage device, a computer-readable storage substrate, a random or serial access memory array or device, or a combination of one or more of them. Moreover, while a computer storage medium is not a propagated signal, a computer storage medium can be a source or destination of computer program instructions encoded in an artificially-generated propagated signal. The computer storage medium can also be, or be included in, one or more separate components or media (e.g., multiple CDs, disks, or other storage devices). Accordingly, the computer storage medium may be tangible and non-transitory.

The operations described in this specification can be implemented as operations performed by a data processing apparatus on data stored on one or more computer-readable storage devices or received from other sources.

The term "client or "server" include all kinds of apparatus, devices, and machines for processing data, including by way of example a programmable processor, a computer, a system on a chip, or multiple ones, or combinations, of the foregoing. The apparatus can include special purpose logic circuitry, e.g., an FPGA (field programmable gate array) or an ASIC (application-specific integrated circuit). The apparatus can also include, in addition to hardware, code that creates an execution environment for the computer program in question, e.g., code that constitutes processor firmware, a protocol stack, a database management system, an operating system, a cross-platform runtime environment, a virtual machine, or a combination of one or more of them. The apparatus and execution environment can realize various different computing model infrastructures, such as web services, distributed computing and grid computing infrastructures.

A computer program (also known as a program, software, software application, script, or code) can be written in any form of programming language, including compiled or interpreted languages, declarative or procedural languages, and it can be deployed in any form, including as a standalone program or as a module, component, subroutine, object, or other unit suitable for use in a computing environment. A computer program may, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub-programs, or portions of code). A computer program can be deployed to be executed on one computer or on multiple computers that are located at one site or distributed across multiple sites and interconnected by a communication network.

The processes and logic flows described in this specification can be performed by one or more programmable processors executing one or more computer programs to perform actions by operating on input data and generating output. The processes and logic flows can also be performed by, and apparatus can also be implemented as, special purpose logic circuitry, e.g., an FPGA (field programmable gate array) or an ASIC (application specific integrated circuit).

Processors suitable for the execution of a computer program include, by way of example, both general and special purpose microprocessors, and any one or more processors of any kind of digital computer. Generally, a processor will receive instructions and data from a read-only memory or a random access memory or both. The essential elements of a computer are a processor for performing actions in accordance with instructions and one or more memory devices for storing instructions and data. Generally, a computer will also include, or be operatively coupled to receive data from or transfer data to, or both, one or more mass storage devices for storing data, e.g., magnetic, magneto-optical disks, or optical disks. However, a computer need not have such devices. Moreover, a computer can be embedded in another device, e.g., a mobile telephone, a personal digital assistant (PDA), a mobile audio or video player, a game console, a Global Positioning System (GPS) receiver, or a portable storage device (e.g., a universal serial bus (USB) flash drive), to name just a few. Devices suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory can be supplemented by, or incorporated in, special purpose logic circuitry.

To provide for interaction with a user, embodiments of the subject matter described in this specification can be implemented on a computer having a display device, e.g., a CRT (cathode ray tube), LCD (liquid crystal display), OLED (organic light emitting diode), TFT (thin-film transistor), plasma, other flexible configuration, or any other monitor for displaying information to the user and a keyboard, a pointing device, e.g., a mouse, trackball, etc., or a touch screen, touch pad, etc., by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input. In addition, a computer can interact with a user by sending documents to and receiving documents from a device that is used by the user; for example, by sending web pages to a web browser on a user's client device in response to requests received from the web browser.

Embodiments of the subject matter described in this specification can be implemented in a computing system that includes a back-end component, e.g., as a data server, or that includes a middleware component, e.g., an application server, or that includes a front-end component, e.g., a client computer having a graphical user interface or a Web browser through which a user can interact with an embodiment of the subject matter described in this specification, or any combination of one or more such back-end, middleware, or front-end components. The components of the system can be interconnected by any form or medium of digital data communication, e.g., a communication network. Examples of communication networks include a local area network ("LAN") and a wide area network ("WAN"), an internetwork (e.g., the Internet), and peer-to-peer networks (e.g., ad hoc peer-to-peer networks).

While this specification contains many specific embodiment details, these should not be construed as limitations on the scope of any inventions or of what may be claimed, but rather as descriptions of features specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product embodied on a tangible medium or packaged into multiple such software products.

Thus, particular embodiments of the subject matter have been described. Other embodiments are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain embodiments, multitasking and parallel processing may be advantageous.

The background section is intended to provide a background or context to the invention recited in the claims. The description in the background section may include concepts that could be pursued, but are not necessarily ones that have been previously conceived or pursued. Therefore, unless otherwise indicated herein, what is described in the background section is not prior art to the description or claims and is not admitted to be prior art by inclusion in the background section.

What is claimed is:

1. An actuator in a building HVAC system, the actuator comprising:

a housing;

a mechanical transducer;

an input connection configured to receive a voltage signal having a power supply line voltage; and a voltage divider circuit comprising:

a first capacitor disposed in series between the input connection and the mechanical transducer, the first capacitor having a capacitance value based on an electrical impedance of the mechanical transducer;

a second capacitor arranged in parallel with the first capacitor between the input connection and the mechanical transducer; and a switch operable to connect and disconnect at least one of the first capacitor and the second capacitor from the voltage divider circuit, wherein operating the switch adjusts a capacitance between the input connection and the mechanical transducer;

wherein the voltage divider circuit is configured to receive the power supply line voltage from the input connection, to use the first capacitor to reduce the power supply line voltage to a reduced voltage, and to provide the reduced voltage to the mechanical transducer, wherein the input connection comprises:

a first input connection configured to receive a voltage signal for driving the mechanical transducer in a first direction; and a second input connection configured to receive a voltage signal for driving the mechanical transducer in a second direction opposite the first direction.

2. The actuator of claim 1, wherein the voltage divider circuit is located within the housing of the actuator or within an adaptor configured to attach to the housing of the actuator.

3. The actuator of claim 1, wherein the capacitance value is based on an electrical inductance of the mechanical transducer.

4. The actuator of claim 1, wherein the capacitance value is based on a voltage value of the power supply line voltage.

5. The actuator of claim 1, wherein the voltage divider circuit comprises:

the first capacitor and the second capacitor disposed in parallel with each other and in series between the first input connection and the mechanical transducer; and a third capacitor disposed in series between the second input connection and the mechanical transducer.

6. The actuator of claim 1, further comprising:

a user-operable switch attached to the housing and configured to switch between multiple different values for the capacitance.

7. The actuator of claim 1, wherein the voltage divider circuit is configured to measure the power supply line voltage and to adjust an impedance between the input connection and the mechanical transducer based on the measured line voltage.

8. The actuator of claim 7, wherein adjusting the impedance between the input connection and the mechanical transducer comprises at least one of connecting and disconnecting the first capacitor from the voltage divider circuit.

9. The actuator of claim 7, wherein adjusting the impedance between the input connection and the mechanical transducer comprises:

determining an impedance of the mechanical transducer;

using the impedance of the mechanical transducer and the measured power supply line voltage to calculate an impedance required to reduce the power supply line voltage to the reduced voltage; and adjusting the impedance between the input connection and the mechanical transducer to achieve the reduced voltage.

10. A method for operating an actuator in a HVAC system using a power line voltage, the method comprising:

providing an actuator comprising a housing, a mechanical transducer, and an input connection configured to receive a voltage signal having a power supply line voltage;

arranging a voltage divider circuit in series between the input connection and the mechanical transducer, the voltage divider circuit comprising multiple capacitors arranged in parallel with each other, a first capacitor of the multiple capacitors having a capacitance value based on an electrical impedance of the mechanical transducer;

receiving the power supply line voltage at the voltage divider circuit via the input connection;

using the first capacitor to reduce the power supply line voltage to a reduced voltage;

providing the reduced voltage from the voltage divider circuit to the mechanical transducer; and operating a switch arranged in series with at least one of the multiple capacitors to electrically connect or disconnect at least one of the multiple capacitors from the voltage divider circuit, wherein operating the switch adjusts a capacitance between the input connection and the mechanical transducer, wherein the input connection comprises:

a first input connection configured to receive a voltage signal for driving the mechanical transducer in a first direction; and a second input connection configured to receive a voltage signal for driving the mechanical transducer in a second direction opposite the first direction.

11. The method of claim 10, further comprising:

locating the voltage divider circuit either within the housing of the actuator or within an adaptor configured to attach to the housing of the actuator.

12. The method of claim 10, further comprising:

using at least one of an electrical inductance of the mechanical transducer and a voltage value of the power supply line voltage to calculate the capacitance value; and selecting the first capacitor from a set of multiple different capacitors based on the calculated capacitance value.

13. The method of claim 10, further comprising:

using a user-operable switch attached to the housing to switch between multiple different values for the capacitance.

14. The method of claim 10, further comprising:

measuring the power supply line voltage; and adjusting an impedance between the input connection and the mechanical transducer based on the measured power supply line voltage;

wherein adjusting the impedance between the input connection and the mechanical transducer comprises at least one of connecting and disconnecting the first capacitor from the voltage divider circuit.

15. The method of claim 10, further comprising:

measuring the power supply line voltage;

determining an impedance of the mechanical transducer;

using the impedance of the mechanical transducer and the measured power supply line voltage to calculate an impedance required to reduce the power supply line voltage to the reduced voltage; and adjusting the impedance between the input connection and the mechanical transducer to achieve the reduced voltage.

16. An actuator in a building HVAC system, the actuator comprising:

a housing;

a mechanical transducer;

an input connection configured to receive a voltage signal having a power supply line voltage;

a voltage divider circuit comprising a capacitor disposed in series between the input connection and the mechanical transducer, the capacitor having a capacitance value based on an electrical impedance of the mechanical transducer; and a time out circuit;

wherein the voltage divider circuit is configured to receive the power supply line voltage from the input connection, to use the capacitor to reduce the power supply line voltage to a first reduced voltage, and to provide the first reduced voltage to the mechanical transducer;

wherein the voltage divider circuit is configured to provide a second reduced voltage, different from the first reduced voltage, to the time out circuit.

17. The actuator of claim 16, wherein the voltage divider circuit is located within the housing of the actuator or within an adaptor configured to attach to the housing of the actuator.

18. The actuator of claim 16, wherein the input connection comprises:

a first input connection configured to receive a voltage signal for driving the mechanical transducer in a first direction; and a second input connection configured to receive a voltage signal for driving the mechanical transducer in a second direction opposite the first direction.

19. The actuator of claim 18, wherein the voltage divider circuit comprises:

a first capacitor disposed in series between the first input connection and the mechanical transducer; and a second capacitor disposed in series between the second input connection and the mechanical transducer.

* * * * *